United States Patent [19]

Fukushima

[11] 4,060,985

[45] Dec. 6, 1977

[54] EXHAUST SYSTEM OF AN INTERNAL COMBUSTION ENGINE

[75] Inventor: Tsugio Fukushima, Nagahama, Japan

[73] Assignee: Yanmar Diesel Engine Co., Ltd., Osaka, Japan

[21] Appl. No.: 666,000

[22] Filed: Mar. 11, 1976

[30] Foreign Application Priority Data

Mar. 13, 1975 Japan ..... 50-34493[U]

[51] Int. Cl.[2] ..... F01N 5/04

[52] U.S. Cl. ..... 60/319; 60/320; 123/41.64; 181/259

[58] Field of Search ..... 123/41.7, 41.64; 60/319, 320, 321, 317; 181/40

[56] References Cited

U.S. PATENT DOCUMENTS

| | | | |
|---|---|---|---|
| 862,250 | 8/1907 | Herman | 123/41.64 |
| 3,512,279 | 5/1970 | Benson | 123/41.64 |
| 3,643,759 | 2/1972 | Bailey | 181/40 |
| 3,798,769 | 3/1974 | Bailey | 181/40 |

FOREIGN PATENT DOCUMENTS

| | | | |
|---|---|---|---|
| 382,005 | 11/1907 | France | 123/41.64 |
| 257,522 | 3/1928 | Italy | 181/40 |

*Primary Examiner*—Douglas Hart

*Attorney, Agent, or Firm*—Ladas, Parry, Von Gehr, Goldsmith & Deschamps

[57] ABSTRACT

An exhaust system of an internal combustion engine especially adapted for use as a power source for a portable tool such as a chain saw, said exhaust system comprising a muffler enclosed within an engine casing and located within the passage of the cooling air flow for cooling the engine, and an exhaust gas dilution system consisting of an ejector connected to the outlet of said muffler and a diffuser disposed at such a position that the outlet of said ejector is opened into the inlet of said diffuser.

2 Claims, 2 Drawing Figures

EXHAUST SYSTEM OF AN INTERNAL COMBUSTION ENGINE

BACKGROUND OF THE INVENTION

The present invention relates to an exhaust system of an internal combustion engine, and more particularly an exhaust system of an internal combustion engine especially adapted for use as a power source for a portable tool such as a chain saw.

The muffler of an internal combustion engine of a portable chain saw or the like rises to a high temperature during the operation so that it must be enclosed within a cover in order to prevent an operator from directly touching the muffler and consequently being seriously burned. In addition, an internal-combustion-engine-powered portable machine or tool such as a portable chain saw must be made as light in weight as possible for permitting the easy handling of the portable machine or tool. For this purpose, the muffler, among others, must be made as light in weight as possible, but in order to maintain the safeguarded and pollution-free working conditions, the sound attenuation efficiency as well as the exhaust gas cleaning or exhaust emission control efficiency cannot be sacrificed at all.

SUMMARY OF THE INVENTION

In view of the above, the object of the present invention is to provide an exhaust system of an internal combustion engine which is light in weight yet capable of sufficiently attenuating the sound of exhaust gases as well as lowering the temperature thereof.

This object have been attained by the exhaust system wherein a muffler is enclosed in an engine casing so that direct touching of an operator to the muffler is prevented. Further, in the exhaust system, an exhaust gas dilution system consisting of an ejector connected to the outlet of said muffler and a diffuser disposed at such a position that the outlet of said ejector is opened into the inlet of said diffuser, is provided. By the provision of such dilution system, the exhaust gas discharged from the outlet of the diffuser is sufficiently diluted with fresh air and the temperature thereof is also lowered sufficiently.

BRIEF DESCRIPTION OF THE DRAWINGS

The above and other objects, features and advantages of the present invention will become more apparent from the following description of one preferred embodiment thereof taken in conjunction with the accompanying drawing, in which.

DETAILED DESCRIPTION OF THE PREFERRED EMBODIMENT

Figure 1:
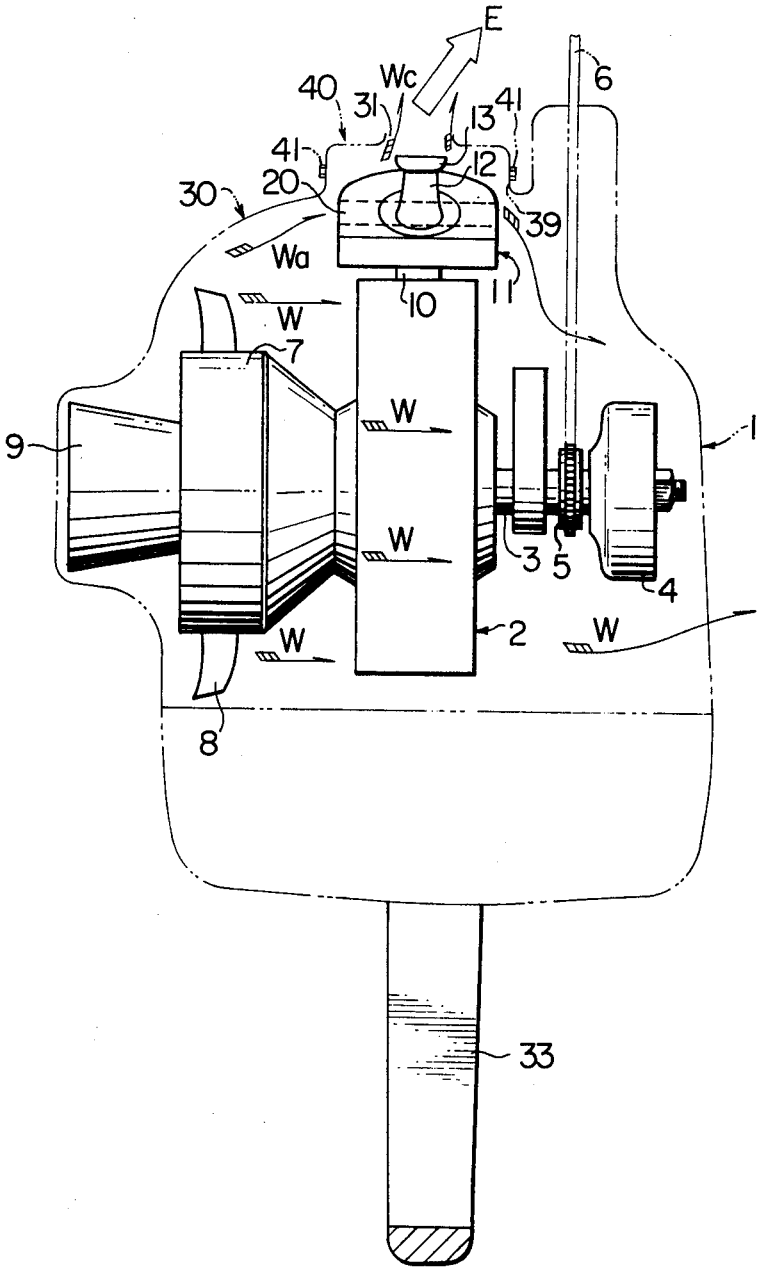
FIG. 1 is a schematic view of a powered portable chain saw incorporating therein an exhaust system of an internal combustion engine in accordance with the present invention.

In the description to be followed of one preferred embodiment, the present invention is applied to a portable chain saw powered with a small internal combustion engine, Referring first to FIG. 1, the chain saw includes an internal combustion engine body 2 with its driving shaft 3 extended therethrough. One end (the right end in FIG. 1) of the driving shaft 3 is drivingly coupled through a centrifugal clutch 4 to a sprocket wheel 5 around which is wrapped an endless saw chain 6 while the other end is joined to a flywheel magnet 7 provided with fan blades 8 and to a recoil starter 9.

Figure 2:
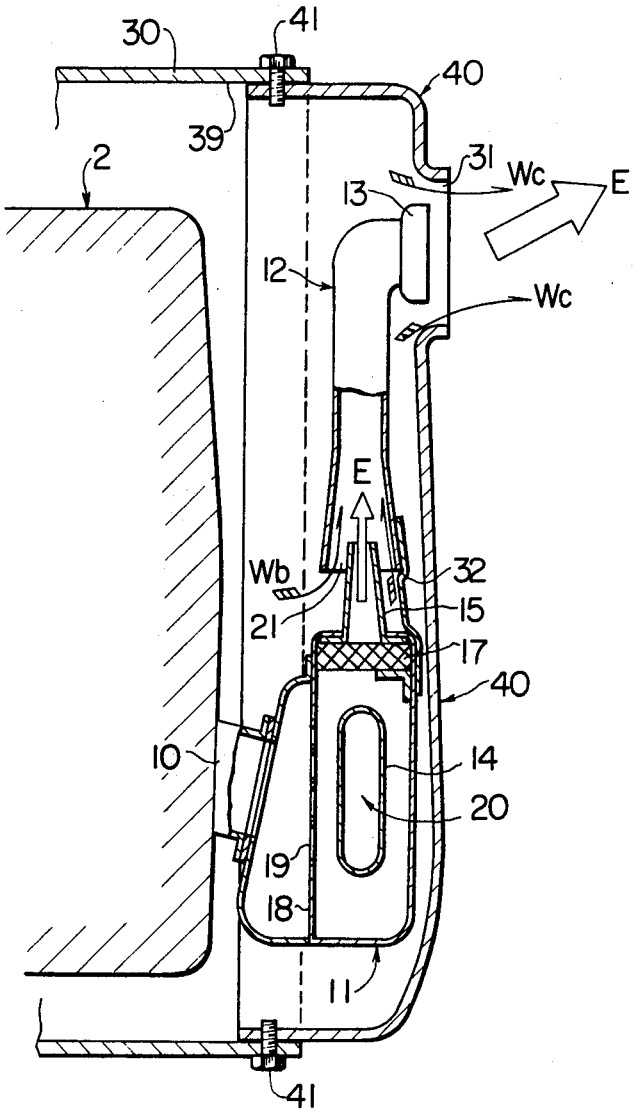
FIG. 2 is a sectional view, on enlarged scale, showing particularly the exhaust system thereof.

An exhaust pipe 10 of the engine body 2 is connected to a muffler 11 to be described in more detail hereinafter. The engine body 2 and the muffler 11 with their associated parts are all enclosed within an engine cover or casing 30 with a handle 33. The engine casing 30 has an opening 39 the diameter of which is sufficiently greater than the outer dimensions of the muffler 11, and is covered with a muffler cover 40 which is detachably mounted on the engine casing 30 with bolts 41 as best shown in FIG. 2.

Next referring particularly to FIG. 2, the exhaust system of the chain saw will be described in more detail hereinafter. The exhaust system comprises the muffler 11 the inlet of which is connected to the exhaust pipe 10 of the engine body 2 and the outlet of which is connected to an ejector 15 which opens into a diffuser 12 joined to the muffler 11 with a stay 32. The ejector 15 and the diffuser 12 constitute an exhaust gas dilution system.

The muffler 11 has a partition wall 18 with holes 19 for attenuating the sound of the exhaust gases, and a cooling air passage 20 defined by a cooling air duct 14 through which flows part W*a* of the cooling air W for cooling the exhaust gases flowing through the muffler 11. When the exhaust gases E are discharged through the ejector 15 into the diffuser 12, they are mixed with the air W*b* entrained into the diffuser 12 through an annular opening 21 defined between the inlet of the diffuser 12 and the ejector 15 so that the exhaust gases may be sufficiently dilluted with the fresh air. The dilluted exhaust gases are discharged from the outlet 13 of the diffuser 12 which is located coaxially of an exhaust opening 31 formed through the muffler cover 40 and which has an outer diameter smaller than the inner diameter of the exhaust opening 31. Therefore, when the dilluted exhaust gases are discharged out of the outlet 13 and the exhaust opening 31, they are surrounded by the cooling air W*c* which flows out of the engine casing 30 under the positive pressure and is also entrained by the discharged exhaust gases.

A wire woven screen 17 is disposed at the outlet of the muffler 11 opening into the ejector 15 so that the unburned compounds in the exhaust gases may be burned before they are discharged and that the emission of sparks may be positively prevented.

Next the effects, features and advantages of the exhaust system with the above construction will be described. Since the exhaust gases from the muffler 11 are discharged through the exhaust gas dilution system consisting of the ejector 15 and the diffuser 12, the exhaust gases may be diluted and lower sufficiently in temperature. This ensures pollution-free working conditions. Since the exhaust system is enclosed by the engine cover 30 and the muffler cover 40, not only the sound of the exhaust gases is arrested by these covers but also a worker operating the chain saw may be positively prevented from directly touching the muffler 11 and consequently being burnt. Furthermore the muffler 11 may be prevented from the direct contact with the withered or dry grass or the like in operation so that a forest fire or the like may be prevented. Thus, the exhaust system in accordance with the present invention may ensure the safeguarded operations.

What is claimed is:

1. An exhaust system of an internal combustion engine comprising a muffler enclosed within an engine casing and located in the path of cooling air flow for cooling the engine characterized in that said muffler is provided with an ejector connected to the outlet of said muffler and defining a convergent exhaust gas passage, and a cylindrical diffuser with its inlet arranged concentric overlapping relation to the outlet of said ejector so that an annular cooling air passage having a cross-sectional area and an axial lapping length suitable for introducing desired volume of cooling air thereinto and with its outlet arranged with respect to an exhaust opening of the engine casing such that the mixture of the exhaust gas and the cooling air issuing from the outlet of the diffuser is further surrounded with cooling air flow, said muffler and diffuser being arranged crosswise to the general direction of the cooling air flow.

2. An exhaust system as claimed in claim 1 wherein said muffler is formed therein with a cooling air passage extending in the general direction of the cooling air flow.

* * * * *